US007152997B1

(12) United States Patent
Kovacik et al.

(10) Patent No.: US 7,152,997 B1
(45) Date of Patent: Dec. 26, 2006

(54) LED UTILITY LIGHT WITH STAND

(75) Inventors: James D. Kovacik, Brecksville, OH (US); Paul S. Blanch, Broadview Heights, OH (US); Joseph J. Smith, Wooster, OH (US)

(73) Assignee: Alert Safety Lite Products Co., Inc., Bedford Heights, OH (US)

( * ) Notice: Subject to any disclaimer, the term of this patent is extended or adjusted under 35 U.S.C. 154(b) by 0 days.

(21) Appl. No.: 11/242,740

(22) Filed: Oct. 4, 2005

(51) Int. Cl.
*F21V 23/04* (2006.01)

(52) U.S. Cl. ..... 362/251; 362/191; 362/287; 362/250

(58) Field of Classification Search ..... 362/251, 362/250, 244, 418, 191, 287
See application file for complete search history.

(56) References Cited

U.S. PATENT DOCUMENTS

| | | | | |
|---|---|---|---|---|
| D135,092 | S | | 2/1943 | Biller |
| 2,932,018 | A | * | 4/1960 | Schwartz ..... 362/486 |
| 3,560,730 | A | | 2/1971 | Morton |
| D235,573 | S | | 6/1975 | Brych |
| 4,156,893 | A | | 5/1979 | Baake |
| 4,262,327 | A | | 4/1981 | Kovacik et al. |
| 4,432,043 | A | | 2/1984 | Yuen |
| 4,442,984 | A | | 4/1984 | Bayat |
| 4,463,413 | A | | 7/1984 | Shirley |
| 4,598,344 | A | | 7/1986 | Nadler |
| 4,774,647 | A | | 9/1988 | Kovacik et al. |
| 4,929,199 | A | | 5/1990 | McKinnon |
| 4,958,267 | A | | 9/1990 | Baake |
| 5,023,764 | A | | 6/1991 | McKinnon et al. |
| 5,050,055 | A | | 9/1991 | Lindsay et al. |
| 5,115,382 | A | | 5/1992 | Smith |
| 5,117,345 | A | | 5/1992 | Baake |
| 5,195,823 | A | | 3/1993 | Sidabras |
| 5,243,505 | A | | 9/1993 | Carr |
| 5,243,507 | A | | 9/1993 | Atkins et al. |
| 5,301,093 | A | | 4/1994 | Baggio |
| D348,249 | S | | 6/1994 | Hester |
| 5,386,358 | A | | 1/1995 | Hillinger |
| 5,410,453 | A | | 4/1995 | Ruskouski |
| 5,436,815 | A | | 7/1995 | Grooms et al. |
| 5,465,196 | A | | 11/1995 | Hasenberg et al. |
| 5,528,477 | A | | 6/1996 | Carmo |
| 5,541,822 | A | | 7/1996 | Bamber |
| 5,700,089 | A | | 12/1997 | McKinnon |
| D389,931 | S | | 1/1998 | Kovacik et al. |

(Continued)

OTHER PUBLICATIONS

Ferret Worklite AC, Jun. 4, 2002, www.ferretinstruments.com.

(Continued)

*Primary Examiner*—Renee Luebke
*Assistant Examiner*—Zahra I. Bennett
(74) *Attorney, Agent, or Firm*—Butzel Long

(57) ABSTRACT

A utility light includes a housing having a rear wall attached to a forwardly extending peripheral wall to form a front opening, a stand rotatably attached to the housing to permit the light to rotate relative to a support surface, a plurality of LEDs mounted in the housing facing the front opening, and a lens removably attached to the housing and closing the front opening. The LEDs are divided between an inner circuit board and a plurality of outer circuit boards adjacent the edges of the inner board. The outer circuit boards and corresponding portions of the lens are angled relative to the inner circuit board and a central portion of the lens. The light can be operated to light all and less than all of the LEDs.

14 Claims, 7 Drawing Sheets

U.S. PATENT DOCUMENTS 5,765,941 A 6/1998 Vest
5,797,672 A * 8/1998 Dobert ..... 362/190
5,818,234 A 10/1998 McKinnon
5,890,794 A * 4/1999 Abtahi et al. ..... 362/294
D409,776 S 5/1999 Ghode et al.
5,921,658 A 7/1999 Kovacik et al.
5,975,719 A 11/1999 Reiff et al.
5,984,490 A 11/1999 Leen
D421,142 S 2/2000 Bayat
D421,143 S 2/2000 Kovacik et al.
6,123,434 A 9/2000 Meltzer
6,132,071 A 10/2000 Yuen
6,169,373 B1 1/2001 Riesinger
6,176,592 B1 1/2001 Kovacik et al.
6,260,442 B1 7/2001 Bayat
D449,398 S 10/2001 Tsao
D451,226 S 11/2001 Leen
6,367,949 B1 4/2002 Pederson
6,386,736 B1 5/2002 Reiff et al.
D458,400 S 6/2002 Kovacik et al.
6,431,728 B1 * 8/2002 Fredericks et al. ..... 362/249
D462,802 S 9/2002 Kovacik et al.
6,534,926 B1 3/2003 Miller et al.
6,554,459 B1 4/2003 Yu et al.
D483,508 S 12/2003 Galvez
D483,893 S 12/2003 Galvez
D484,628 S 12/2003 Bayat et al.
6,663,265 B1 12/2003 Kovacik et al.
D486,599 S 2/2004 Bayat et al.
6,707,389 B1 * 3/2004 Pederson ..... 340/815.45
6,722,774 B1 4/2004 Kovacik et al.
6,769,791 B1 * 8/2004 Kovacik et al. ..... 362/287
D502,276 S 2/2005 Kovacik et al.
6,857,756 B1 2/2005 Reiff et al.
6,902,295 B1 6/2005 Galvez
6,951,406 B1 * 10/2005 Becker ..... 362/127
2002/0191396 A1 12/2002 Reiff et al.
2003/0039121 A1 2/2003 Nezigane
2003/0123254 A1 7/2003 Brass et al.
2003/0179572 A1 9/2003 Schnell
2004/0228124 A1 11/2004 Reiff et al.
2005/0265035 A1 12/2005 Brass et al.

OTHER PUBLICATIONS

Bayco SL-2105, Bayco SL-2106, Apr. 1, 2003, www.budgetlighting.com.

* cited by examiner

LED UTILITY LIGHT WITH STAND

BACKGROUND OF THE INVENTION

The present invention relates generally to illumination devices and, in particular, to a free-standing utility light having a light source configured as an array of LEDs.

Portable lights that can be manually moved and suspended about a work site to aid a user to obtain the best lighting conditions, are well known. Such lights are often referred to as trouble lamps, extension lights, work lights, inspection lights, utility lights, and the like, and are commonly employed by mechanics and other workers who require a concentration of light while frequently changing locations. Such lights have developed from using incandescent bulbs to using fluorescent bulbs. The fluorescent bulbs have several advantages in use as compared with the incandescent bulbs. For example, a fluorescent light bulb usually provides more light with less glare than an incandescent light bulb of the same wattage.

Many prior art utility lights are designed to be handheld, which is advantageous in that they may be easily moved to many locations. While their portability and light weight is advantageous, handheld lights are often limited in the amount of illumination that they can provide because the larger bulbs, support assemblies and power supply components required to provide more illumination increase the weight and would make the handheld light more difficult to hold and orient. Those skilled in the art will also appreciate that though a greater amount of illumination is preferred at times, the same amount of illumination is not in required for every work location.

Light emitting diodes (LEDs) are well known for providing illumination to digital displays and the like. It has become more common for an array of LEDs to be utilized for providing illumination in work spaces. LEDs are particularly advantageous because of their low power consumption per candlepower produced when compared to incandescent light bulbs and, to a lesser degree, to fluorescent light bulbs.

It is desirable to provide a utility light having lower power consumption that also provides sufficient illumination for a work site. It is also desirable to be able to place and orient the utility light in as many locations and positions as possible. It is always desirable to provide utility lights that are lightweight and cost-effective to produce.

SUMMARY OF THE INVENTION

The present invention concerns an LED utility light having a housing and a lens member enclosing at least one LED circuit board assembly and a reflector member mounted in the housing. Preferably, an O-ring is disposed between the housing and the lens member. The assembled housing and lens member are pivotally mounted on a stand for rotation about a horizontal axis. Once positioned, the housing and lens can be locked against further rotation relative to the stand. The stand functions as a base to support the utility light in a freestanding position, as a mounting bracket for attaching to a surface. The reflector member has a reflective surface facing the lens member.

The housing is generally square with a rear wall and a peripheral wall extending forwardly from the rear wall forming a front opening closed by the lens. A first group of less than all of the LEDs is mounted on an inner circuit board assembly wherein the rear wall, the inner circuit board assembly and a central portion of the lens extend in generally parallel planes. The LEDs not included in the first group are mounted on a plurality of outer circuit board assemblies positioned around the inner circuit board assembly. Each of the outer circuit board assemblies and an associated outer portion of the lens extend in generally parallel planes angled relative to the plane of the rear wall. A switch connected to the LEDs selectively applies electrical power to the first group in a first switch mode and applies electrical power to a second group of the LEDs in a second switch mode, the second group being one of all of the LEDs and all of the LEDs not included in the first group.

DESCRIPTION OF THE DRAWINGS

The above, as well as other advantages of the present invention will become readily apparent to those skilled in the art from the following detailed description of a preferred embodiment when considered in the light of the accompanying drawings in which.

DESCRIPTION OF THE PREFERRED EMBODIMENT

Figure 4:
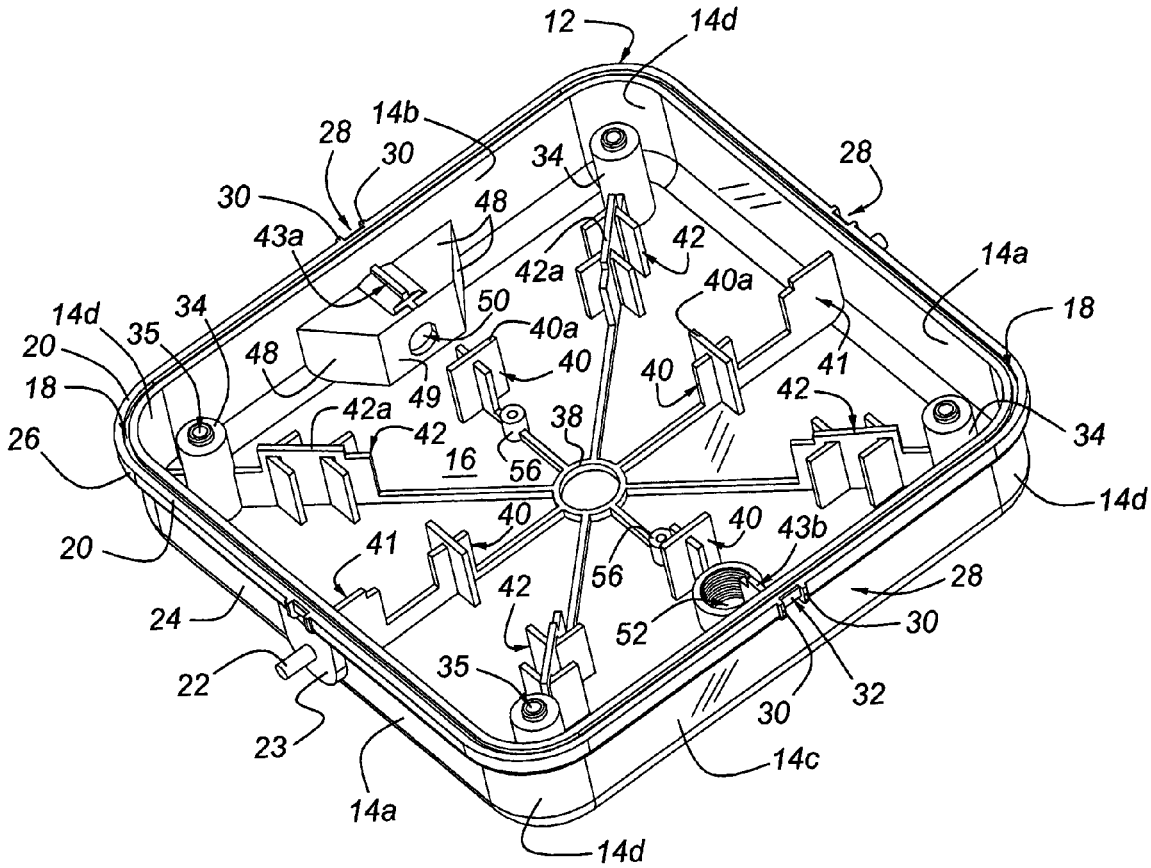
FIG. 4 is a perspective view of the interior of the housing of the utility light shown in FIG. 1.

Referring now to all of the Figures, a utility light in accordance with the present invention is indicated generally at 10. The utility light 10 includes a generally square housing 12 having a peripheral wall 14 formed in four straight portions shown in FIG. 4 as a pair of opposed side portions 14*a*, a top portion 14*b* and a bottom portion 14*c*. The portions 14*a*, 14*b* and 14*c* are connected by four rounded corners 14*d* and extend forwardly from the periphery of a rear wall 16 thereof. The wall 14 has a groove 18 formed in a forwardly facing free edge 20 for cooperating with a lens member, discussed in more detail below, and includes a pair of preferably threaded studs 22 each extending outwardly from an associated pad 23 on an exterior surface 24 of the opposed side portions 14*a*. The free edge 20 also includes a peripheral flange 26 extending outwardly from the exterior surface 24. The flange 26 has a slot 28 formed between opposed ribs centered along each of the portions 14*a*, 14*b* and 14*c*, the slots and the ribs extending rearwardly from the free edge 20. The slots 28 are defined by a flat 32 extending between the ribs 30.

Figure 2:
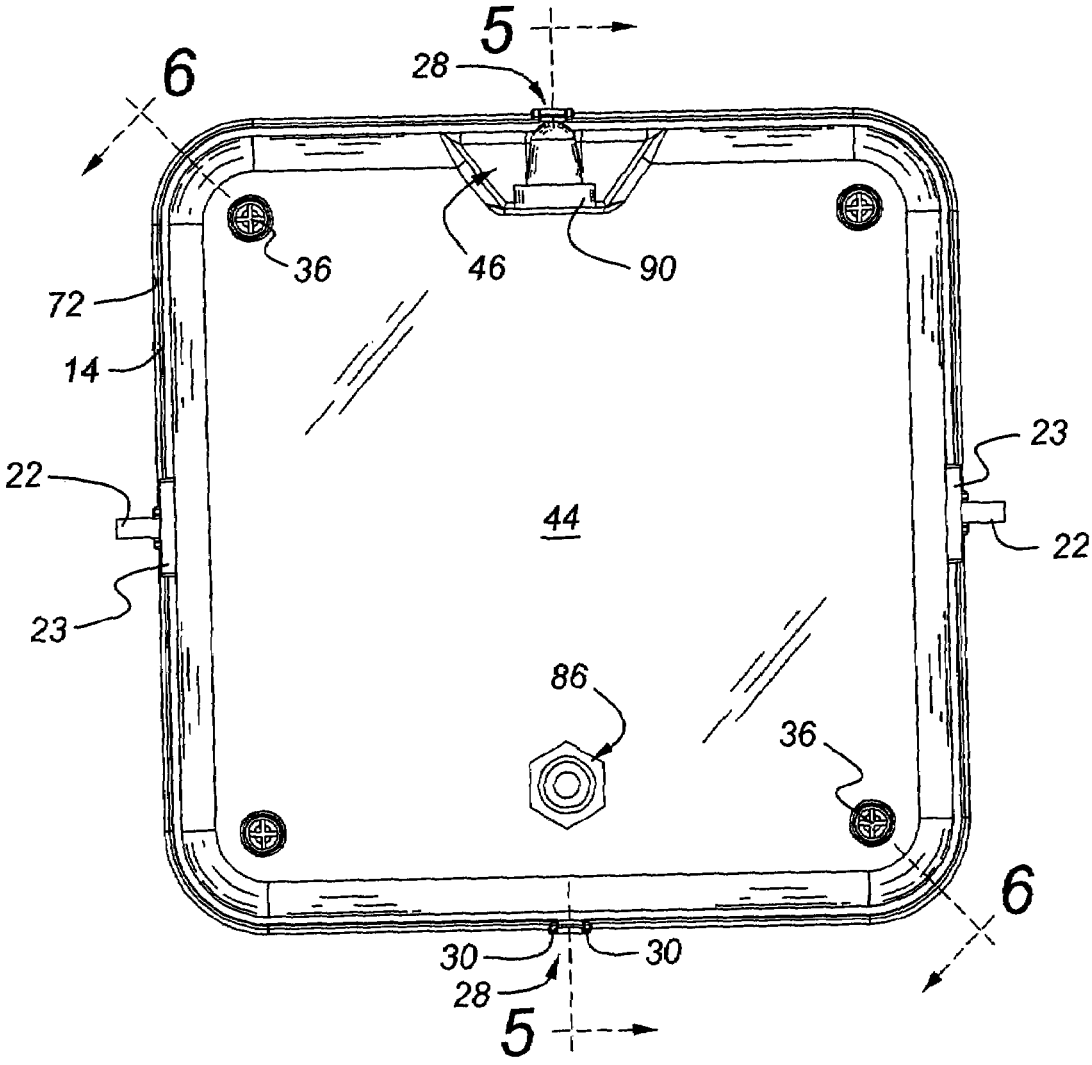
FIG. 2 is a rear elevation view of the LED utility light of FIG. 1 shown without the stand.

The rear wall 16 of the housing 12 includes a plurality of bosses 34 extending forwardly from an interior surface adjacent the corners 14*d*, each boss having an aperture extending therethrough for receiving fasteners 36 (FIG. 2) when the utility light 10 is assembled. An annular rib 38 is centered on the interior surface of the wall 16. A plurality of inner brackets 40 that are each spaced an approximately equal radial distance from the central rib 38 extend inwardly from the interior surface of the wall 16. Each of the brackets 40 is positioned centrally relative to an associated one of the straight portions of the wall 14. An upper surface 40*a* of each of the inner brackets 40 is substantially parallel to the interior surface of the wall 16. Two of the inner brackets 40 have a radially outwardly spaced auxiliary bracket 41 connected thereto adjacent the side portions 14*a*. A plurality of outer brackets 42 extend inwardly from the interior surface of the wall 16 and are located at a greater radial distance from the central flange 38 than the inner brackets 40. Each of the brackets 42 is positioned radially between an associated one of the bosses 34 and the rib 38. An upper surface 42*a* of each of the outer brackets 42 is preferably sloped radially downwardly toward the central rib 38, best seen in FIG. 6, such that a radial outward portion of the upper surface 42*a* is at a greater distance from the interior surface of the wall 16 than a radial inward portion of the upper surface 42*a*.

An exterior surface 44 of the rear wall 16 and the peripheral wall top portion 14*b* have a recess or depression 46 formed therein. The recess 45 is centered along the top portion 14*b* and is defined by three side walls 48 and a bottom wall 49 having a switch aperture 50 formed therein. A tubular power cord passage 52 extends inwardly from the interior surface of the rear wall 16 near the bottom portion 14*c*. The apertures 35 of the bosses 34 extend through the rear wall 16 for receiving the fasteners 36. An upper alignment bracket 43*a* extends forwardly from one of inner walls 48 of the depression 46 and a lower alignment bracket 43*b* extends forwardly from the interior surface of the rear wall 16 between the power cord passage 52 and the bottom portion 14*c*.

Figure 3:
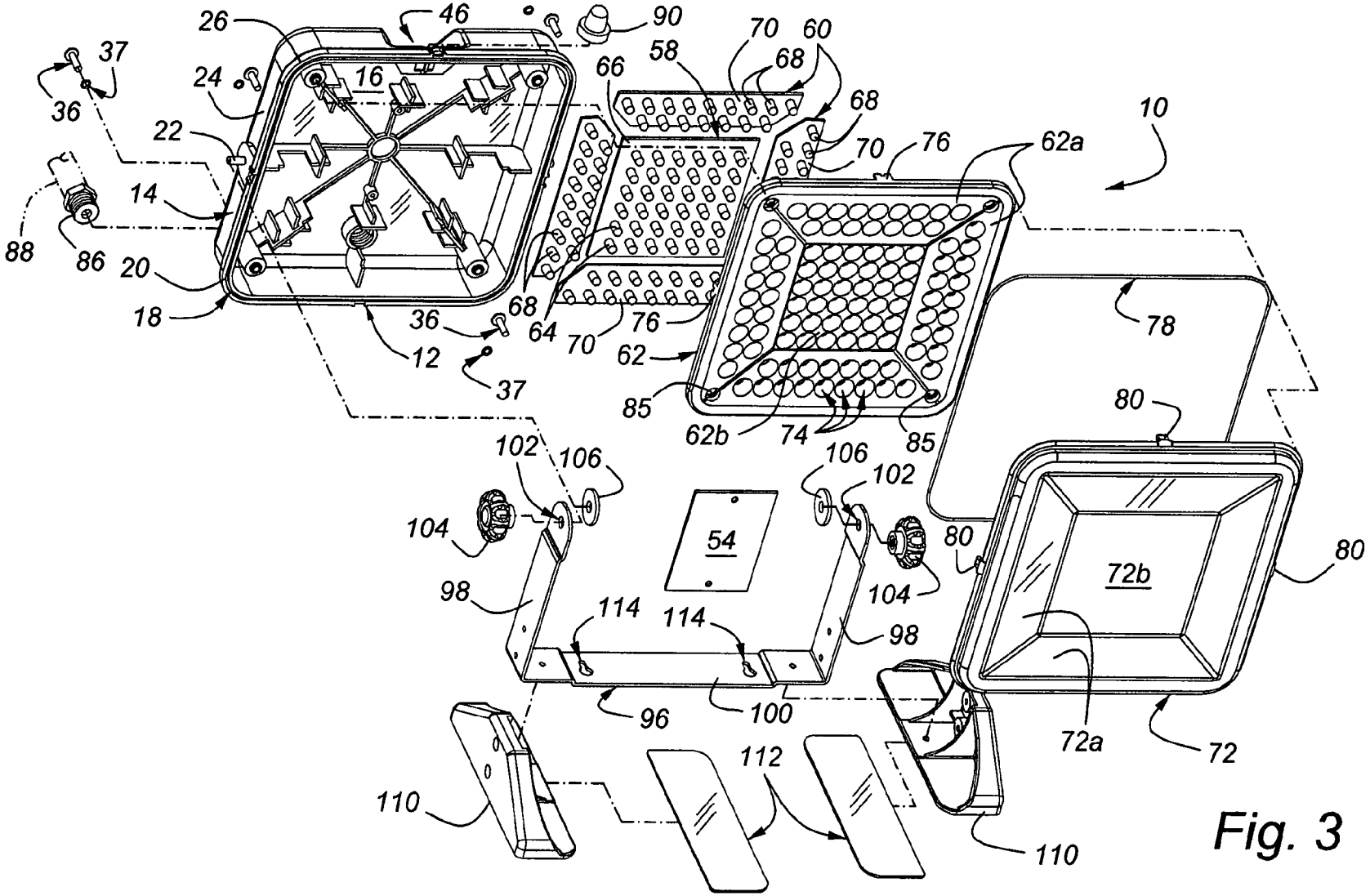
FIG. 3 is an exploded perspective view of the LED utility light of FIG. 1.

A central printed circuit board (PCB) 54 is mounted in the housing 12 on a pair of mounting posts 56 extending forwardly from the interior surface of the rear wall 16 between the central rib 38 and associated ones of the brackets 40. An inner LED circuit board assembly 58 and a plurality of outer LED circuit board assemblies 60 are mounted in the housing 12 between a reflector member 62 and the brackets 40, 41, 42, 43*a*, and 43*b*. The LED circuit board assembly 58 is generally square and includes a plurality of LEDs 64 mounted on a front surface 66 thereof. Each of the outer LED circuit board assemblies 60 is generally rectangular with two angled corners and includes a plurality of LEDs 68 mounted on a front surface 70 thereof. As seen in FIG. 3, each of the outer LED circuit board assemblies 60 is positioned adjacent an associated edge of the inner LED circuit board assembly 58 such that the angled corners cooperate to prevent overlap. The LEDs form an array with the LEDs 64 being a center of the array and the LEDs 68 being a periphery of the array.

The reflector member 62 is positioned between the circuit board assemblies 58 and 60 and a lens member 72 and includes a plurality of spaced apart through apertures 4. The front surface of the reflector member 62 is preferably mirror chrome plated or has a similar highly reflective surface. The apertures 74 correspond in number and position to the LEDs 64 and 68 on the circuit board assemblies 58 and 60. The walls of the reflector member 62 that define each of the apertures 64 are also mirror chrome plated and taper radially outwardly from a rear surface of the reflector member 62 to the front surface of the reflector member 62 to form a generally cone-shape profile, best seen in FIGS. 5 and 6. The reflector member 62 includes a plurality of tabs 76 extending rearwardly therefrom for cooperating with the brackets 41, 43*a*, and 43*b* when the utility light 10 is assembled. The reflector member 62 is preferably formed generally concave or cone-shaped or dish-shaped, best seen in FIG. 2, wherein a plurality of peripheral portions 62*a* of the reflector member 62, corresponding to the outer LED circuit board assemblies 60, slopes rearwardly toward a central portion 62*b* of the reflector member 62 corresponding to the inner LED circuit board assembly 58.

A gasket or O-ring 78 is adapted to be disposed in the groove 18 between the forwardly facing surface 20 of the peripheral wall 14 and a corresponding mating surface of the lens member 72. The exterior surface of the lens member 72 includes a plurality of outer portions 72*a* sloping rearwardly towards a central portion 72*b*. The outer portions 72*a* correspond to the peripheral portions 62*a* of the reflector member 62 and the central portion 72*b* corresponds to the central portion 62*b* of the reflector member 62. The lens member 72 is preferably formed of a transparent material and includes a plurality of hooks 80 extending therefrom that preferably correspond in number and location to the slots 28 formed in the housing 12. Each of the hooks 80 includes an engagement portion 82, best seen in FIG. 5, that snaps over a corresponding one of the flats 32 when the utility light 10 is assembled. The hooks 80 can be released by finger pressure to release the lens 72 from the housing 12.

Figure 6:
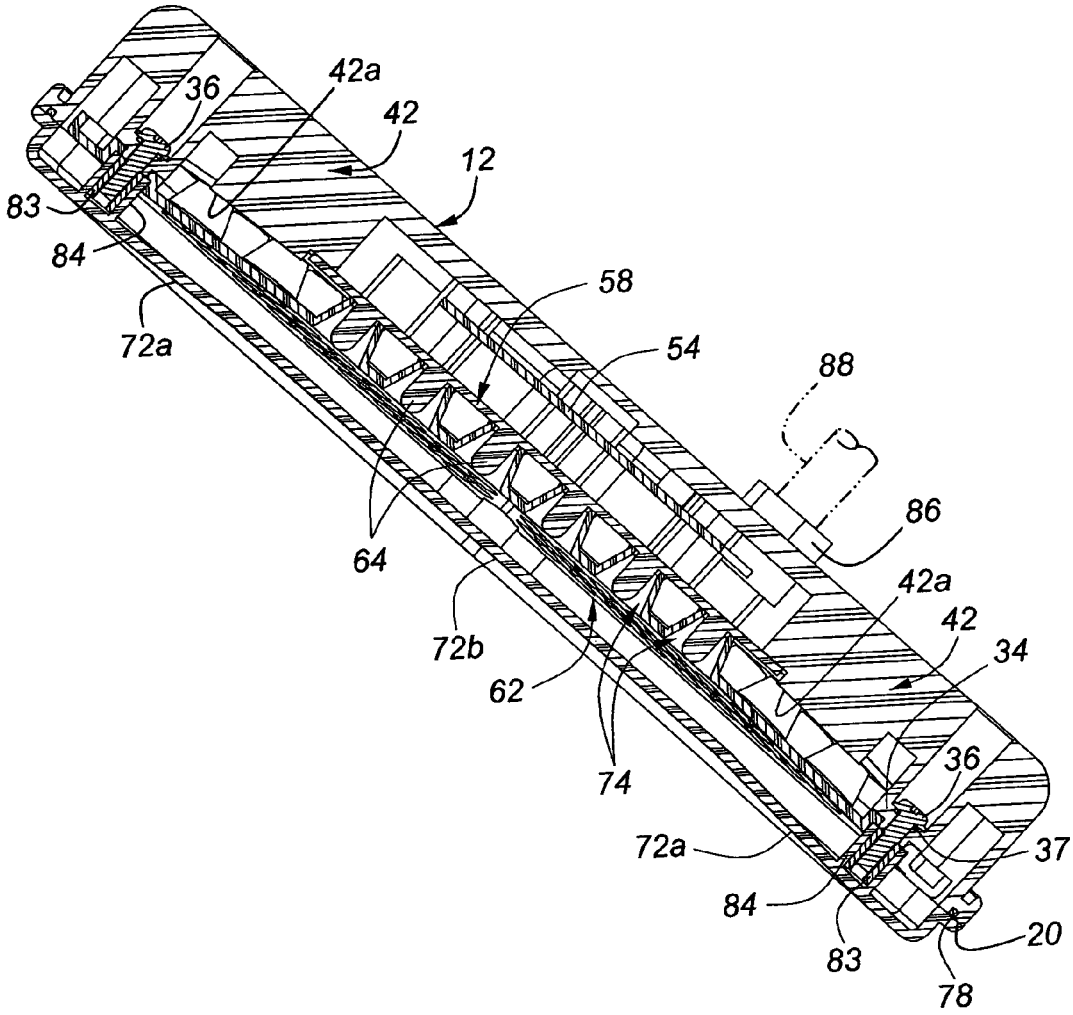
FIG. 6 is a cross-sectional view taken along line 6—6 in FIG. 2.

A plurality of hollow posts 84, best seen in FIG. 6, extend from an inner surface of the lens member 72 and through corresponding apertures 85 formed in the reflector member 62. The bosses 34 of the housing 12 are counterbored to recess the fasteners 36 when the utility light 10 is assembled. The fasteners 36 each extend through a gasket or O-ring 37 that, in conjunction with the O-ring 78, assist in ensuring a watertight seal of the interior of the assembled utility light 10. Each of the fasteners 36 threadably engages an associated tubular retainer or nut 83 that is slidably received in a corresponding one of the hollow posts 84.

Figure 5:
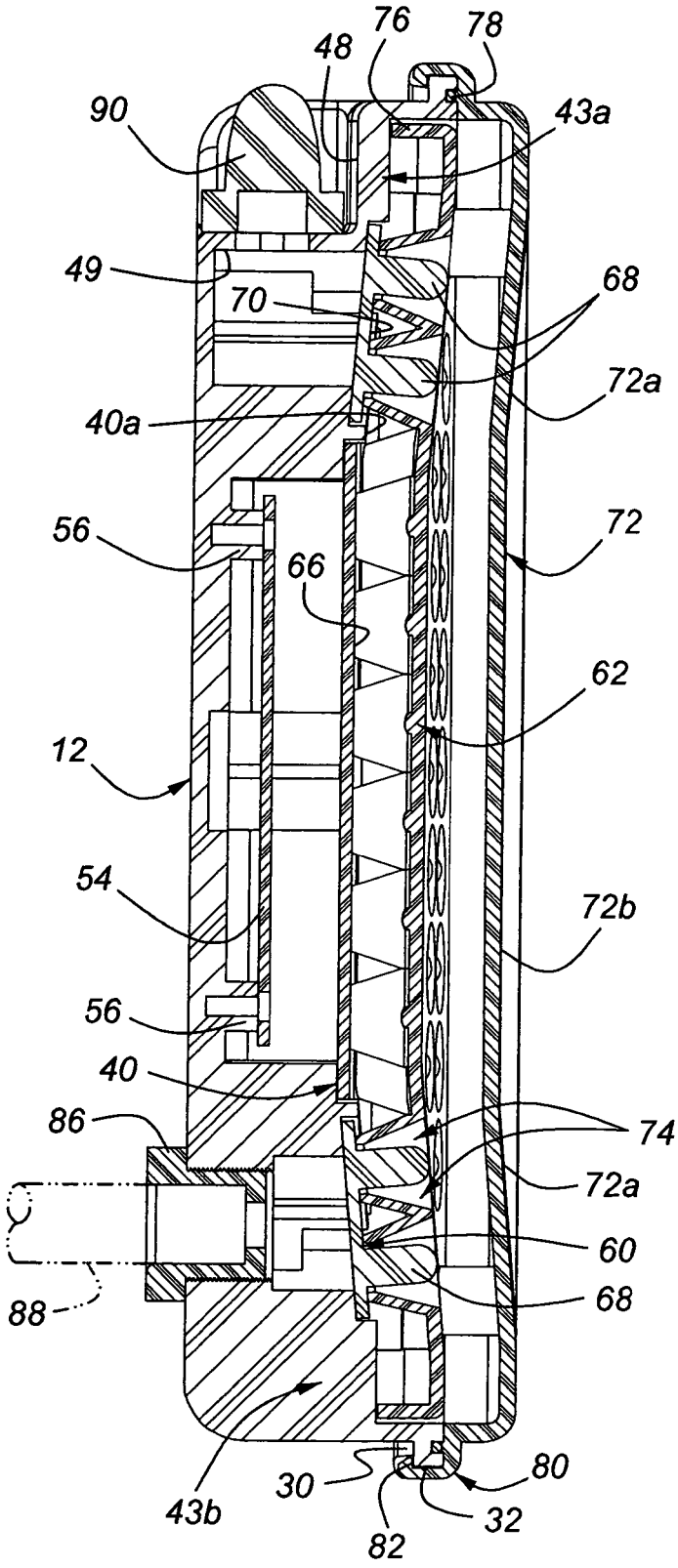
FIG. 5 is a cross-sectional view taken along line 5—5 in FIG. 2.
Figure 7:
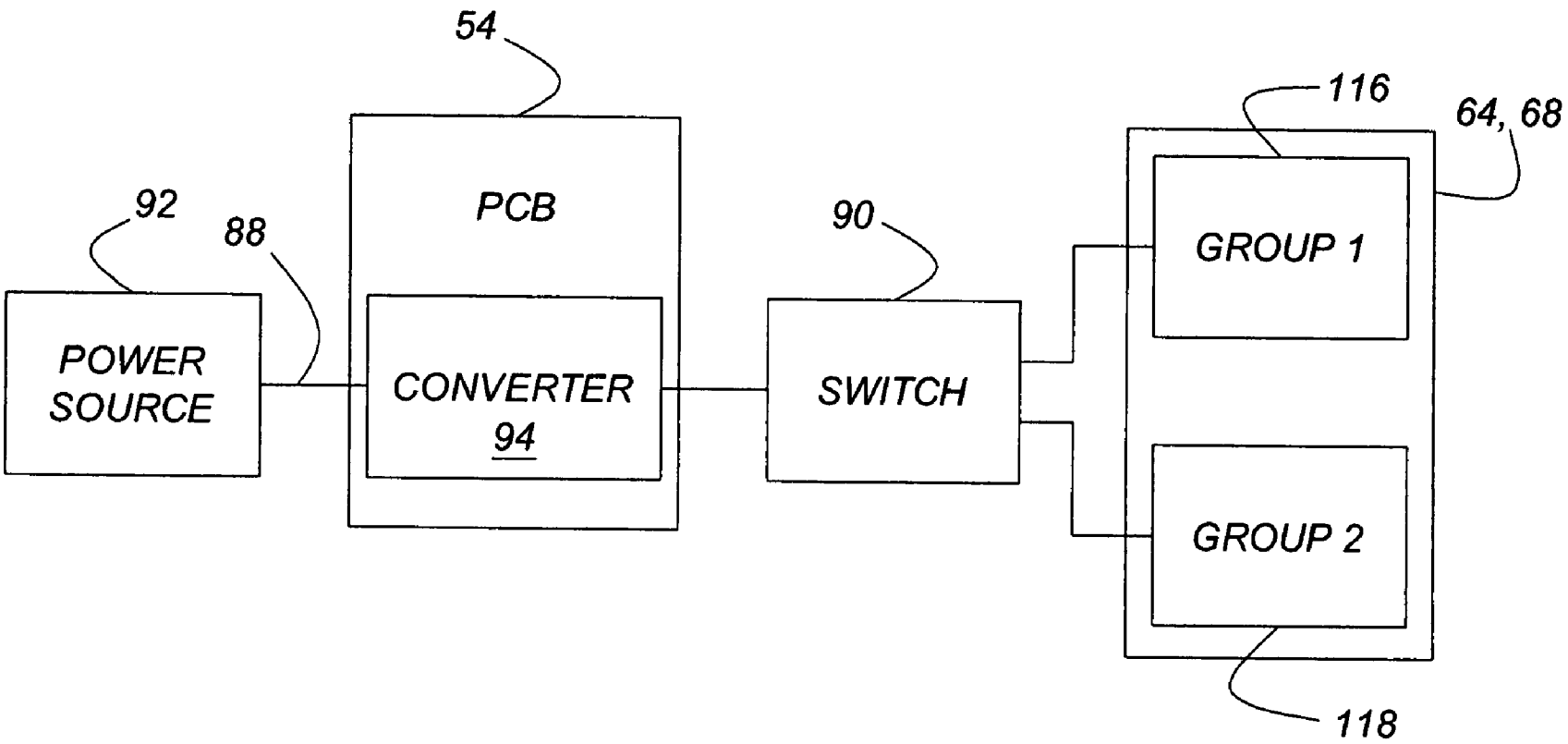
FIG. 7 is an electrical schematic of the utility light shown in FIG. 1.

A strain relief means 86 is adapted to be disposed in the power cord passage 52 to receive a power cord, shown in FIGS. 3, 5, and 6 in phantom at 88, to provide power to the circuitry, discussed below, that is enclosed within the light 10. A switch 90 is received in the switch aperture 50. The switch 90 is preferably a push button type that electrically connects power from a power source 92 connected to the power cord 88 to an input of a conventional AC/DC power converter 94, best seen in FIG. 7. The converter 94 can be a separate unit mounted in the housing 12, or can be a circuit on the circuit board 54, as shown in FIG. 7. The LEDs 64 and 68 are connected to an output of the converter 94 through the switch 90 and are operable to emit light in a well-known manner when a DC voltage is provided by the converter 94.

Figure 1:
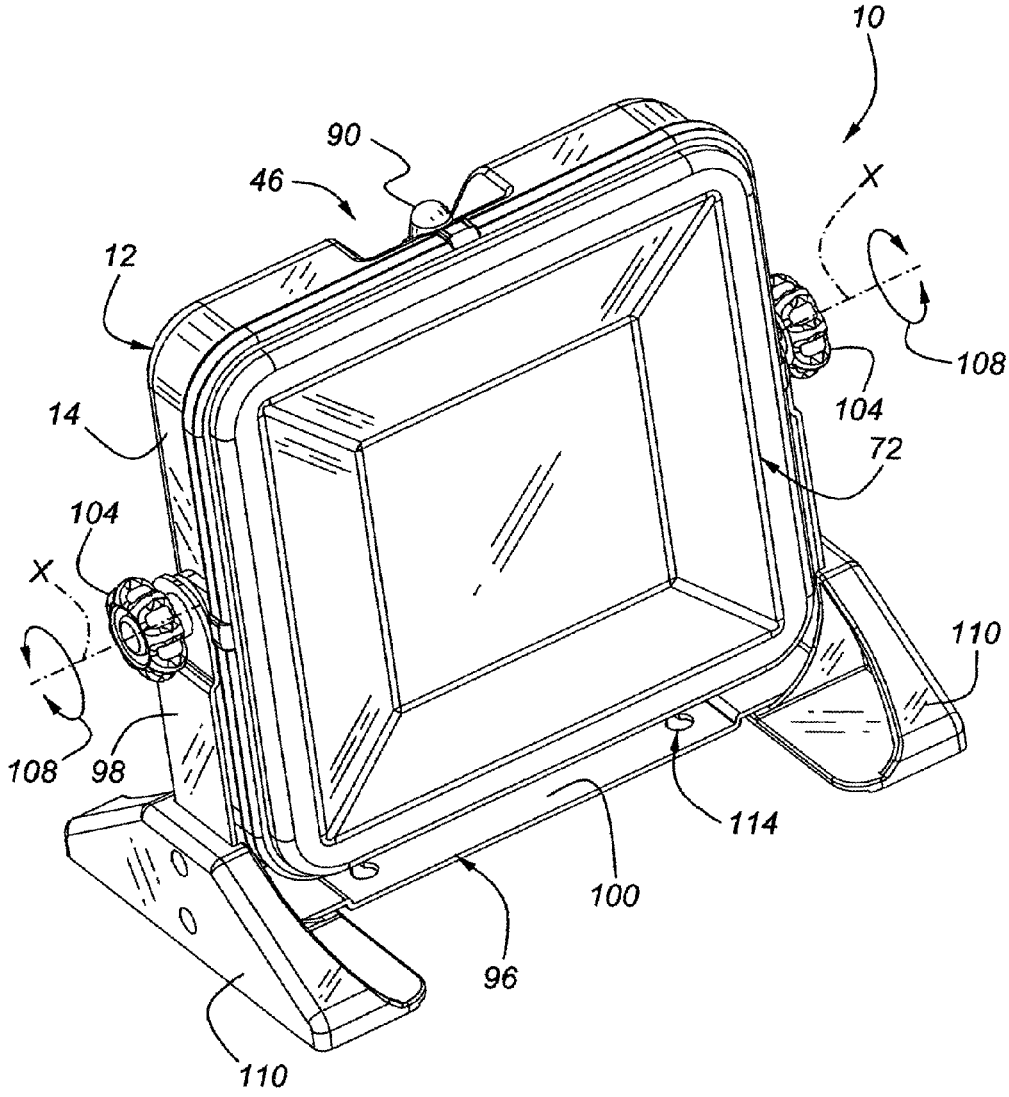
FIG. 1 is a front perspective view of an LED utility light with stand in accordance with the present invention.

The utility light 10 includes a generally U-shaped stand 96 having a pair of upstanding legs 98 extending from opposite ends of a generally planar bar 100. An upper end of each of the legs 98 includes an aperture 102 through which extends an associated one of the threaded studs 22 of the housing 12. Each of a pair of knobs 104 threadably engages a free end of an associated one of the studs 22 to retain the associated leg 98 on the stud 22. A washer 106 is positioned between the surface 23 and the facing surface of the leg 98 adjacent the aperture 102. When the knobs 104 are tightened, the legs 98 are held against rotation about the studs 22 so that the housing 12 of the utility light 10 cannot move relative to the stand 96. When the knobs 104 are loosened, the housing 12 can be rotated relative to the stand 96 about a horizontal axis X extending through the studs 22, best seen in FIG. 1. The studs 22 are positioned approximated midway between the top and bottom portions 14*b* and 14*c*. Thus, the direction of the illumination emitted from the lens 72 can be selectively rotated 360 degrees about the axis X as shown by arrows 108 in FIG. 1 and the housing 12 can be locked in a desired position utilizing the knobs 22.

A pair of feet 110 are attached at the juncture of the legs 98 with the bar 100. The feet 110 extend transversely from opposite edges of the bar 100 and have lower surfaces that may include grip cushions 112 attached thereto, such as by adhesive or the like, for supporting the utility light 10. Formed in the bar 100 are slotted apertures 114 each for receiving a head of a fastener (not shown). The housing 12, the knobs 104 and the feet 110 can be formed from a suitable plastic material such as an ABS material or the like. The lens 72 can be formed from another suitable plastic material such as a polycarbonate material or the like.

In a mode of use, the utility light 10 can rest freestanding supported on a generally horizontal surface by the bar 100 and the feet 110. The housing 12 can be rotated about the first axis X to direct the illumination emitted from the lens 72. In another mode of operation, the slotted apertures 114 can accept the heads of screws (not shown) for mounting the utility light 10 on a generally planar surface permitting the housing 12 to be rotated about the first axis X to direct the illumination. In yet another mode of operation, the utility light 10 can be held in a hand using the stand 96 as a handle.

An electrical schematic of the utility light 10 is shown in FIG. 7. The AC to DC converter 94 is provided for converting AC power from the power source 92, when the power cord 88 is connected to the power source 92, to the lower voltage DC power required to power the LEDs 64 and 68 of the LED circuit board assemblies 58 and 60, respectively.

The electrical power from the converter 94 is directed through the switch 90 to the LED circuit board assemblies 58 and 60. The switch 90 has at least a pair of "on" positions wherein in a first "on" position the switch 90 can direct electrical power from the converter 94 to a first group 116 of the LEDs wherein only those LEDs 64 in the central are lighted. In a second "on" position, the switch 90 directs power to light the first group 116 and a second group 118 including all of the LEDs 68.

The utility light 10 shown in FIGS. 1–6 has the LEDs 64 on the circuit board assembly 58 arranged in six columns of six rows for a total of thirty-six LEDs. The LEDs 68 on each of the circuit board assemblies 60 are arranged in two columns having seven and nine LEDs 68, respectively, for a total of sixty-four LEDs. The total number of the LEDs 64 and 68 of the utility light 10 is one hundred. As explained above, the LEDs 64 can be the first group 116 such that thirty-six percent of the total light output is generated in the first "on" position of the switch 90.

Those of ordinary skill in the art will recognize that the switch 90 can be two separate switches wherein the group 116 can be controlled by one switch and the group 118 can be controlled by the other switch such that all of the LEDs 64 and 68 are lighted when both switches are "on". Of course, any number of LEDs can be used and divided into the groups as desired. Further, the switch 90 can have only one "on" position for turning on and off all of the LEDs 64 and 68.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A utility light comprising:

a generally square housing having a rear wall and a peripheral wall extending forwardly from said rear wall forming a front opening;

a plurality of LEDs mounted in said housing facing said front opening;

a lens removably attached to said housing and closing said front opening, said lens including a central portion having a plane extending generally parallel to said rear wall and a plurality of outer portions extending from said central portion and angled relative to said plane of said central portion;

a stand attached to said housing for supporting the utility light on a support surface and permitting rotation of said housing about a predetermined axis;

a first group of less than all of said LEDs being mounted on an inner circuit board assembly retained in said housing;

said LEDs not included in said first group being mounted on a plurality of outer circuit board assemblies positioned around said inner circuit board assembly; and each of said outer circuit board assemblies and an associated one of said outer portions of said lens extending in generally parallel planes angled relative to a plane of said rear wall.

2. The light according to claim 1 wherein said rear wall, said inner circuit board assembly and said central portion of said lens extend in generally parallel planes.

3. The light according to claim 1 including a switch connected to said plurality of LEDs for selectively applying electrical power to said LEDs of said first group in a first switch mode and applying electrical power to a second group of said LEDs in a second switch mode, said second group being one of all of said LEDs and all of said LEDs not included in said first group.

4. The light according to claim 1 wherein a second group of said LEDs includes all of said LEDs not included in said first group.

5. The light according to claim 1 wherein said rear wall and a top portion of said peripheral wall have a recess formed therein, said recess having a bottom wall with an aperture formed therein, and including a switch mounted in said aperture and being connected to said LEDs for selectively applying electrical power to light said LEDs.

6. The light according to claim 1 wherein a first group of less than all of said LEDs is mounted on an inner circuit board assembly retained in said housing and all of said LEDs not included in said first group are mounted on a plurality of outer circuit board assemblies positioned adjacent edges of said inner circuit board assembly.

7. The light according to claim 6 wherein said rear wall, said inner circuit board assembly and said central portion of said lens extend in generally parallel planes and each of said outer circuit board assemblies and an associated one of said outer portions of said lens extend in generally parallel planes angled relative to the plane of said rear wall.

8. The light according to claim 7 wherein said housing has at least one inner bracket supporting said inner circuit board assembly and at least one outer bracket with an angled upper surface supporting each of said outer circuit board assemblies.

9. The light according to claim 1 including a reflector member mounted in said housing adjacent said LEDs.

10. The light according to claim 1 wherein said stand is generally U-shaped providing a grip for a human hand to carry the light.

11. The light according to claim 10 wherein said stand includes a pair of support surface engaging feet.

12. The light according to claim 10 wherein said stand includes a bar having a leg extending from opposed ends thereof, said legs being rotatably attached to said housing, and at least one aperture formed in said bar for receiving a fastener to mount the light to a support surface.

13. A utility light comprising:

a generally square housing having a rear wall and a peripheral wall extending forwardly from said rear wall forming a front opening;

a plurality of LEDs mounted in said housing facing said front opening;

a lens removably attached to said housing and closing said front opening, said lens including a central portion having a plane extending generally parallel to said rear wall and a plurality of outer portions extending from said central portion and angled relative to said plane of said central portion;

a stand attached to said housing for supporting the utility light on a support surface and permitting rotation of said housing about a predetermined axis;

a first group of less than all of said LEDs being mounted on an inner circuit board assembly retained in said housing and all of said LEDs not included in said first group being mounted on a plurality of outer circuit board assemblies positioned adjacent edges of said inner circuit board assembly; and said rear wall, said inner circuit board assembly and said central portion of said lens extending in generally parallel planes and each of said outer circuit board assemblies and an associated one of said outer portions of said lens extending in generally parallel planes angled relative to the plane of said rear wall.

14. The light according to claim 13 wherein said housing has at least one inner bracket supporting said inner circuit board assembly and at least one outer bracket with an angled upper surface supporting each of said outer circuit board assemblies.

* * * * *